US010575702B2

(12) United States Patent
Smith et al.

(10) Patent No.: US 10,575,702 B2
(45) Date of Patent: Mar. 3, 2020

(54) MOP HEAD

(71) Applicant: BONA AB, Malmo (SE)

(72) Inventors: Dan Smith, Westminster, CO (US); Paul Fair, Denver, CO (US); Jamie Kummerfield, Denver, CO (US)

(73) Assignee: BONA AB, Malmo (SE)

( * ) Notice: Subject to any disclaimer, the term of this patent is extended or adjusted under 35 U.S.C. 154(b) by 90 days.

(21) Appl. No.: 15/792,067

(22) Filed: Oct. 24, 2017

(65) Prior Publication Data

US 2018/0042443 A1 Feb. 15, 2018

Related U.S. Application Data

(63) Continuation of application No. 15/488,261, filed on Apr. 14, 2017, now abandoned, which is a continuation-in-part of application No. 14/733,658, filed on Jun. 8, 2015, now abandoned, application No. 15/792,067, filed on Oct. 24, 2017, which is a continuation-in-part of application No. 29/564,226, filed on May 11, 2016, now Pat. No. Des. 819,907.

(60) Provisional application No. 62/013,161, filed on Jun. 17, 2014, provisional application No. 62/015,211, filed on Jun. 20, 2014, provisional application No. 62/015,202, filed on Jun. 20, 2014, provisional application No. 62/017,659, filed on Jun. 26, 2014, provisional application No. 62/017,946, filed on Jun. 27, 2014, provisional application No. 62/017,953, filed on Jun. 27, 2014.

(51) Int. Cl.
*A47L 13/256* (2006.01)
*A47L 13/44* (2006.01)

(52) U.S. Cl.
CPC ..... *A47L 13/256* (2013.01); *A47L 13/44* (2013.01)

(58) Field of Classification Search
CPC ..... A47L 13/256; A47L 13/44
See application file for complete search history.

(56) References Cited

U.S. PATENT DOCUMENTS

| | | | | |
|---|---|---|---|---|
| 3,737,938 | A * | 6/1973 | Saltzstein | A47L 13/256 15/231 |
| 3,792,505 | A * | 2/1974 | Saltzstein | A47L 13/256 15/231 |
| 5,419,015 | A * | 5/1995 | Garcia | A47L 13/20 15/144.2 |
| 6,505,986 | B1 | 1/2003 | Oder | |
| 6,663,306 | B2 | 12/2003 | Policicchio et al. | |
| 6,964,535 | B2 | 11/2005 | Bell et al. | |
| 7,257,854 | B2 | 8/2007 | Petner | |
| 7,427,169 | B2 | 9/2008 | Ma et al. | |
| 7,607,192 | B2 | 10/2009 | Flora et al. | |
| 8,152,400 | B2 | 4/2012 | LaFlamme et al. | |

(Continued)

OTHER PUBLICATIONS

International Search Report for PCT/US2015/036047 dated Sep. 24, 2015, 1 page.

*Primary Examiner* — Randall E Chin
(74) *Attorney, Agent, or Firm* — William O'Meara; Cochran Freund & Young LLC

(57) ABSTRACT

A mop head having a bottom face portion adapted to engage a top surface of a mop pad, a first recessed portion recessed from the bottom face portion and a first fastener strip mounted in the first recessed portion with a bottom surface portion of the fastener strip located in substantially coplanar relationship with the mop head bottom face portion.

7 Claims, 3 Drawing Sheets

(56) References Cited

U.S. PATENT DOCUMENTS

| | | | |
|---|---|---|---|
| 8,807,858 | B2 | 8/2014 | Fitzpatrick et al. |
| 9,565,986 | B2 | 2/2017 | Fair et al. |
| D819,907 | S | 6/2018 | Fair et al. |
| 2009/0241280 | A1 | 10/2009 | Pho et al. |
| 2015/0359402 | A1 | 12/2015 | Correll et al. |
| 2018/0078109 | A1* | 3/2018 | O'Shea ..... A47L 13/256 |

* cited by examiner

MOP HEAD

This application is a continuation of U.S. application Ser. No. 15/488,261, filed Apr. 14, 2017, now abandoned, which is a continuation in part of U.S. application Ser. No. 14/733,658, filed Jun. 8, 2015 for FLOOR MOP of Paul Fair, Jamie Kummerfield and Kristi Correll, now abandoned, which claims the benefit of each of the following prior filed provisional applications: U.S. Provisional Application Ser. No. 62/013,161 filed Jun. 17, 2014 for Floor Mop with Liquid Reservoir in Mop Head of Correll, et. al.; U.S. Provisional Application Ser. No. 62/015,211 filed Jun. 20, 2014 for Mop Head Assembly with Debris Catcher of Correll, et al.; U.S. Provisional Application Ser. No. 62/015,202 filed Jun. 20, 2014 for Mop Pad With Stiffening Ring Member of Correll, et al.; U.S. Provisional Application Ser. No. 62/017,953 filed Jun. 27, 2014 for Mop With Flexible Ears of Correll, et al. U.S. Provisional Application Ser. No. 62/017,946 filed Jun. 27, 2014 for Mop Pad With Strips of Material Having Fibers With Different Orientations of Correll, et al.; and U.S. Provisional Application Ser. No. 62/017,659 filed Jun. 26, 2014 for Floor Mop with Multiple Use Collapsible Flexible Bag of Correll et al. This application is also a continuation in part of U.S. application Ser. No. 29/564,226, filed May 11, 2016 for MOP HEAD of Paul Fair and Jamie Kummerfield. Each patent application or patent or patent publication listed in this paragraph is hereby incorporated by reference for all that it discloses.

BACKGROUND

A conventional mop assembly includes a mop handle attached to a mop head. In most cases a separate cleaning pad is removably attached to the mop head, enabling it to be removed for periodic cleaning or replacement. Various removable attachment assemblies are known, for example, hook and loop type fastener strips that have oppositely positioned cooperating portions mounted on the mop head and on the mop pad, respectively. One prior art mop head has a bottom face plane formed by a web structure. Hook and loop type fastener strips are mounted in recessed corner regions of the bottom face of the mop head. The bottom faces of the fastener strips protrude outwardly beyond the bottom face plane of the mop head.

SUMMARY

A mop head having a bottom face portion adapted to engage a top surface of a mop pad; a first recessed portion recessed from the bottom face portion; and a first fastener strip mounted in the first recessed portion, a bottom surface portion of the fastener strip located in substantially coplanar relationship with the mop head bottom face portion.

A mop assembly includes a mop head having a bottom face portion that includes a first recessed portion. A first fastener strip is mounted in the first recessed portion and has a mop pad attachment face positioned in substantially coplanar relationship with the mop head bottom face portion. A mop handle is attached to the mop head. A mop pad is attachable to the bottom face portion of the mop head by the first fastener strip.

A method of making a mop head includes forming a recess in a bottom face portion of the mop head that has a depth approximately the same as the thickness of a fastener strip assembly to be mounted therein; and securing the fastener strip assembly in the recess such that a lower face of the fastener strip is substantially coplanar with the bottom face portion of the mop head.

DETAILED DESCRIPTION

As used herein, terms such as "top," "bottom," "upper," "lower," "vertical," "lateral" "above," "below," and other such spacial reference terms are used in a relative sense to describe the positions or orientations of certain surfaces/parts/components of a mop assembly in relationship to other such features of a mop assembly when the mop assembly is in a normal upright operating position. Such terms are not used in an absolute sense, i.e., to indicate orientation with respect to a gravitational field. Thus, used in this relative sense, the "top" surface of a mop head is the surface of the mop head that is remote from the floor when the mop head is in normal floor mopping use. According to this usage, this top surface of the mop head would still be correctly referred to as the "top" surface of the mop head, even if the mop were hung upside down in a broom closet.

Applicants have discovered that an uneven distribution of dirt and contaminants on the bottom surface of some mop pads is caused by mop pad attachment strips that are mounted on the mop head for securing a mop pad thereto. The attachment strips protruded from the bottom face of the mop head and most dust collects on the portion of the mop pad directly above the attachment strips. Applicants have solved this problem by recessing the attachment strips in the mop head so that the mop head bottom surface and the attachment strip bottom surface are generally coplanar, i.e., the attachment strips do not protrude from the mop head bottom surface.

Figure 1:
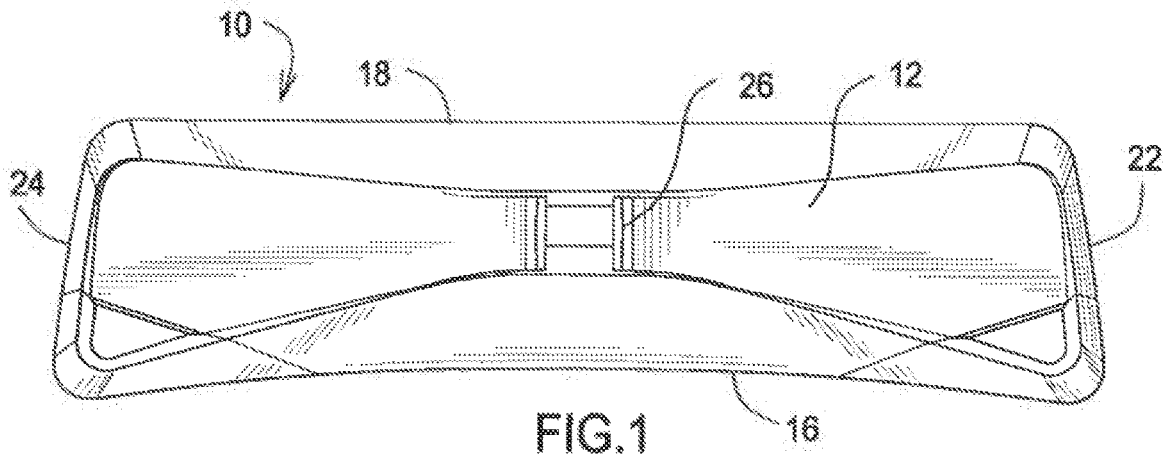
FIG. 1 is a top plan view of a mop head.
Figure 2:
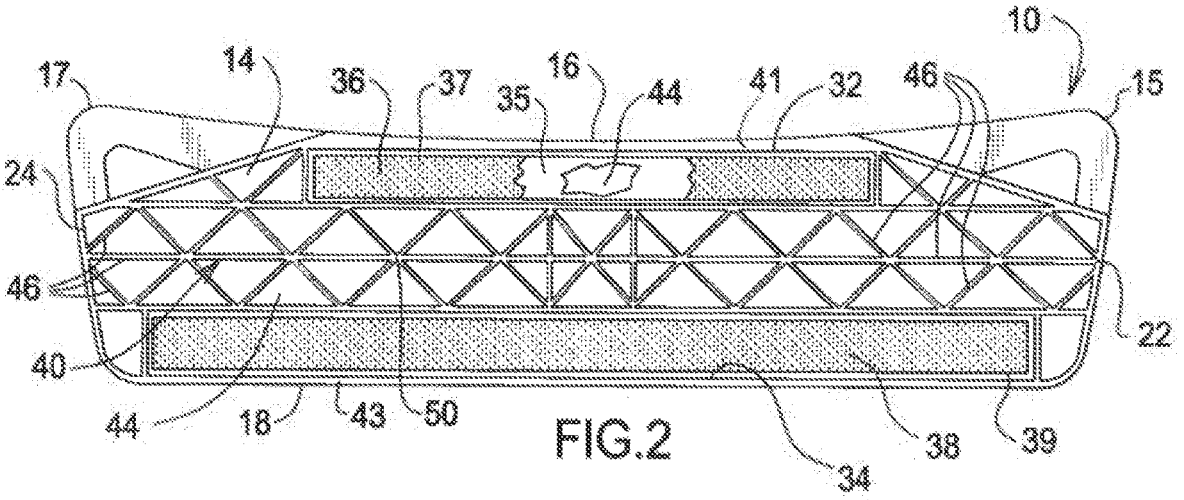
FIG. 2 is a partially cut away bottom plan view of the mop head of FIG. 1.

FIG. 1 is a top plan view of a mop head 10, and FIG. 2 is a bottom plan view thereof. The mop head 10 has a top portion 12, a bottom face portion 14, FIG. 2, a front portion 16 a rear portion 18, a first lateral side portion 22 and a second lateral side portion 24. In one example embodiment, the mop head 10 has flexible ear portions 15, 17. The flexible ear portions 15, 17 may, in some embodiments, e.g., FIG. 5, have ear bottom face portions that are defined partially by a web structure 19. The flexible ear portions 15, 17 are provided on opposite lateral ends of the front portion 16 of the mop head 10 and may be constructed from resilient plastic, rubber, or other elastically resilient material. The front portion 16 of the mop head in the illustrated embodiment has a concave shape. In other embodiments, the front portion may be linear or may have another shape.

Figure 3:
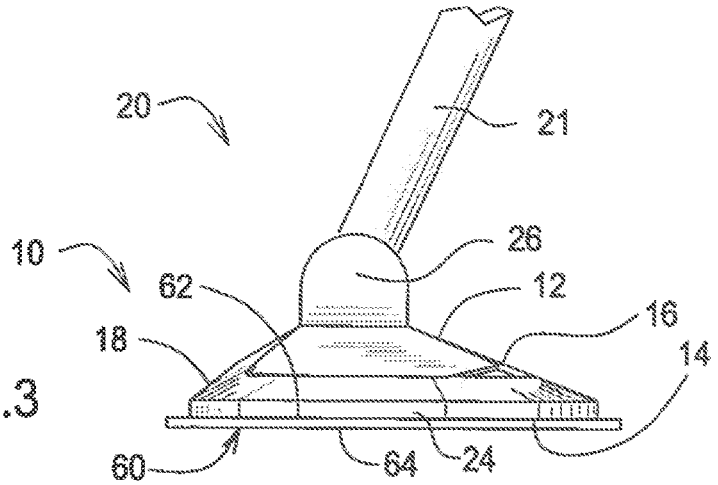
FIG. 3 is an end elevation view of a mop assembly including the mop head of FIGS. 1 and 2.

FIG. 3 is an end elevation view of a mop assembly 20 including the mop head 10 shown in FIGS. 1 and 2. In the mop assembly 20 shown in FIG. 3, the mop head 10 is attached to a mop handle 21, as by a conventional mop handle pivot assembly 26. The mop assembly 20 also includes a flexible mop pad 60 with a top surface 62 and a bottom surface 64. The top surface 62 of the mop pad 60 is removably attachable to the bottom face portion 14 of the mop head 10 by attachment strips 36, 38, as described in further detail below. The top surface 62 of the mop pad 60, in one embodiment, is 100% polyester. The mop pad 60 may be constructed from one or more layers of fabric material to form a pad with generally flat, parallel top and bottom surfaces. Commercially available mop pads suitable for use with the disclosed mop head 10 include those commercially available from Bona AB and BONA USA under the product designations BONA MICROFIBER DUSTING PAD, BONA MICROFIBER CLEANING PAD, and BONA POWERPLUS DEEP CLEAN PAD. A suitable mop pad for the mop assembly 20 is also disclosed in U.S. patent application Ser. No. 15/208,524 filed Jul. 12, 2016 for CLEANING PAD of Weyhmiller, U.S. Patent Application Publication No. US 2017/0014013 A1, published Jan. 19, 2017, now U.S. Pat. No. 10,231,593, which is hereby incorporated by reference of all that it discloses.

Figure 4:
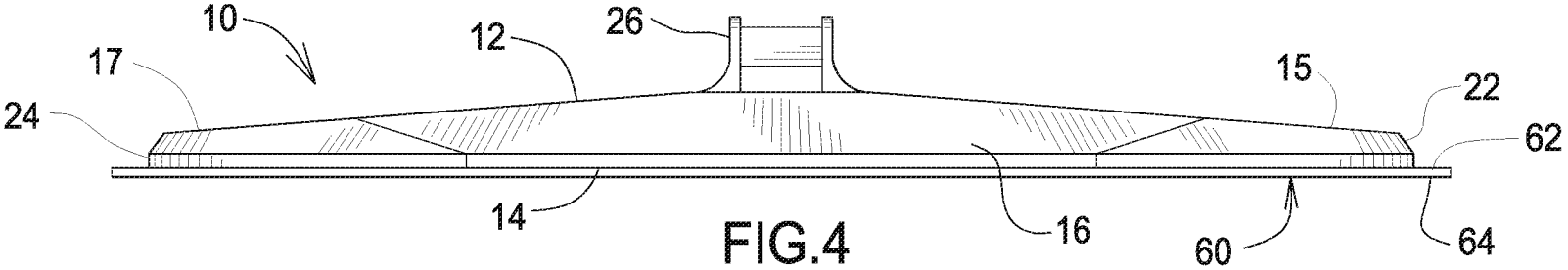
FIG. 4 is a front elevation view of the mop head of FIGS. 1-3 with an attached mop pad.
Figure 5:
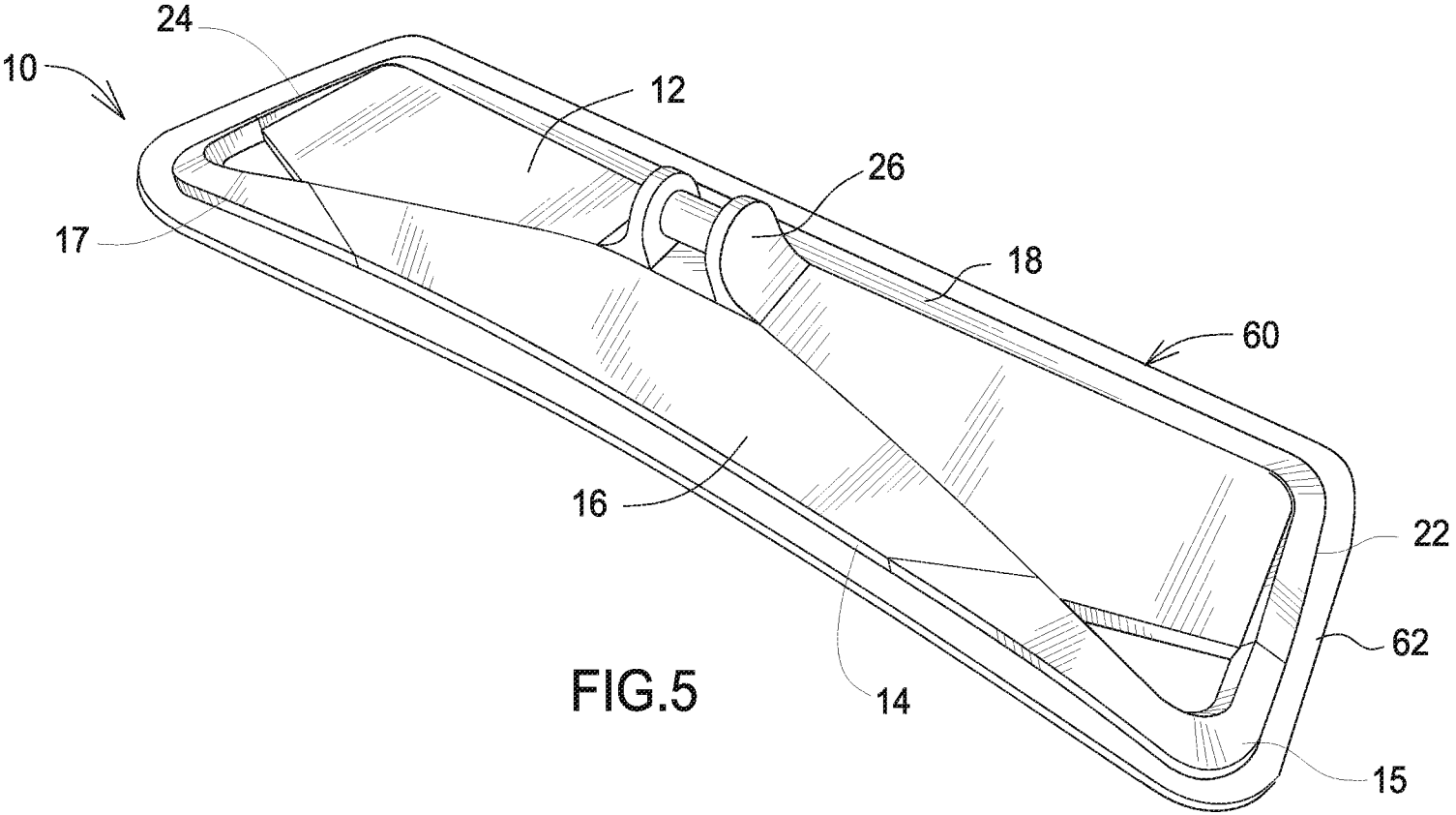
FIG. 5 is a top isometric view of the mop head and attached mop pad of FIG. 4.

FIG. 4 is a front elevation view of the mop head 10 and mop pad 60 shown in FIG. 3. FIG. 5 is a top isometric view thereof.

Figure 6:
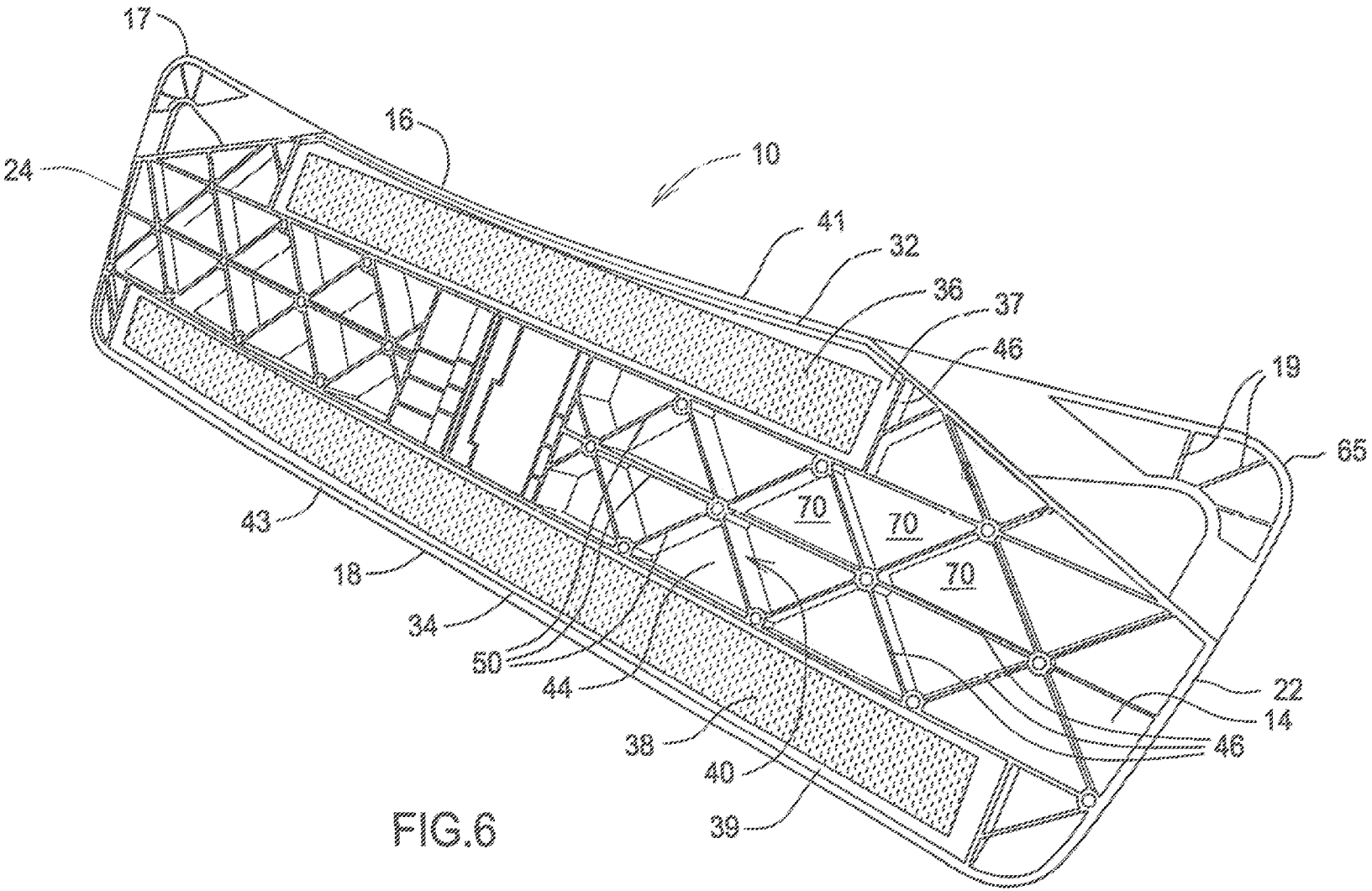
FIG. 6 is a bottom isometric view of the mop head of FIGS. 1 and 2 with modified ear portions.

FIG. 6 is a bottom isometric view of the mop head 10 of FIGS. 1 and 2. As best shown in FIGS. 2 and 6, the mop head bottom face portion 14 comprises a forward elongate recess 32 and a rear elongate recess 34. In the illustrated embodiment, each elongate recess may have a generally rectangular cross-sectional shape. A forward fastener strip 36, also having a generally rectangular cross-sectional shape, is mounted in a forward frame portion 37 with a corresponding cross-sectional shape, as by adhesive. The forward frame portion 37, with the fastener strip 36 mounted therein, is mounted in the forward elongate recess 32. A rear fastener strip 38 is mounted in a rear frame portion 39. The rear frame portion 39 is in turn mounted in the rear elongate recess 34, FIGS. 2 and 6. The rectangular frame portions 37, 39 are adapted to fit closely in the corresponding elongate recesses 32, 34 and may be maintained therein as by conventional adhesive.

The fastener strips 36, 38 may be hook-type fastener strips that are adapted to pierce the flexible mop pad material 60 and releasably hold the flexible mop pad 60 against the mop head 10. The hook-type fastener strips 36, 38 hold the flexible mop pad 60 with sufficient force to enable normal mopping operations while still enabling the mop pad 60 to be pulled off the mop head 10 by hand. Various hook type fastening materials suitable for this purpose are widely commercially available, as for example from the Velcro Companies or The 3M Company.

As shown by FIGS. 2 and 6, the forward elongate recess 32 is defined by portions of a raised webbing structure 40 and by the forward peripheral edge structure 41 of the mop head 10. The rear elongate recess 34 is defined by the raised webbing structure 40 and the rear peripheral edge 43 of the mop head 10. The webbing structure 40 has a plurality of web portions 46 that extend vertically outwardly, i.e., downwardly, when the mop head is in an upright orientation. The webbing structure 40 extends from a flat, somewhat sloped, interior surface 44 of the mop head 10. This interior surface 44 may be the bottom surface of a thin plastic wall that forms the top portion 12 of the mop head 10, FIG. 1. For purposes of illustration, FIG. 2 is provided with a first cut out that exposes a flat horizontal portion 35 of the attachment strip frame member 37. A second cut out extends through this flat horizontal portion 35 of the frame member 37 and exposes the flat interior surface 44. The frame member 37 horizontal portion 35 may be attached to the interior surface 44 of the mop head with adhesive. The webbing structure 40, with a plurality of web portions 46, defines the rear and end portions of the forward elongate recess 32. The rear elongate recess 34 may be formed in the same manner as the forward elongate recess 32.

The lower most edge surface 50 of the webbing structure 40 defines a bottom face plane of the mop head 10 that interfaces with the top surface 62 of a flexible mop pad 60 when the mop pad 60 is attached to the mop head 10, as shown in FIGS. 3-5. In one embodiment, the webbing structure 40 has its greatest vertical dimension at a central part of the mop head bottom portion 14. This vertical dimension may be about 0.5 in in height. The smallest vertical dimension of the webbing structure 40 in one embodiment is located near the periphery of the bottom portion and may be about 0.2 in in height.

The forward and rear elongate recesses 32, 34, the fastener strips 36, 38, and the strip frame portions 37 and 39 are constructed and arranged such that, when the mop head 10 is in a normal operating position, the downward most portion of the fastener strips 36 and 38 are positioned at approximately the same elevation as the lower most edge surfaces 50 of the web structure 40. With this arrangement, the mop pad 60, which has a constant thickness, is provided with a flat bottom face 64 that engages the floor with even pressure thereacross during mopping. Bulging at any portion of the bottom surface 64 of the mop pad has thus been obviated by recessing the attachment strips 32, 34. Excess collection of dirt on areas of the mop pad opposite the fastener strips is eliminated by this construction.

Use of a bottom web structure 40, provides the mop head 10 with relatively high strength and stiffness while requiring a relatively small volume of material. The material from which the mop head 10 is constructed may be a high strength plastic. The web structure 40, in the illustrated embodiment, comprises a plurality of interconnected vertical web portions 46 arranged in a multi-celled, honeycomb-type configuration. These cells 70 are each three sided and have open, triangular, bottom ends, FIG. 6.

Example embodiments of a mop head have been expressly described in detail in this disclosure. Alternative embodiments of mop heads employing one or more of the inventive concepts disclosed herein will occur to others after reading this disclosure. It is intended that the language of the appended claims be construed broadly to cover all such alternative embodiments, except insofar as limited by the prior art.

What is claimed is:

1. A mop head comprising:

a bottom face portion adapted to engage a top surface of a mop pad;

a first recessed portion recessed from said bottom face portion; and a first fastener strip mounted in said first recessed portion, a bottom surface portion of said fastener strip located in substantially coplanar relationship with said mop head bottom face portion;

said bottom face portion of said mop head being defined by a web structure comprising a plurality of interconnected vertical wall portions that define a plurality of adjacent cells.

2. The mop head of claim 1, some of said plurality of interconnected vertical wall portions also defining at least part of said first recessed portion.

3. The mop head of claim 2, a bottom peripheral edge of said mop head defining at least part of said first recessed portion.

4. The mop head of claim 1 wherein said first fastener strip comprises a plurality of hook-type fibers that are adapted to penetrate and releasably hold the mop pad against the mop head bottom face portion during normal mopping operations, said hook-type fibers being adapted to nondestructively release said mop pad when sufficient removal force is applied thereto.

5. A mop head comprising:

a bottom face portion adapted to engage a top surface of a mop pad;

a first recessed portion recessed from said bottom face portion; and a first fastener strip mounted in said first recessed portion, a bottom surface portion of said fastener strip located in substantially coplanar relationship with said mop head bottom face portion;

a second recessed portion and a second fastener strip mounted in said second recessed portion;

said first recessed portion being positioned adjacent a forward edge of said mop head; said second recessed portion being positioned adjacent to a rear edge of said mop head;

said first recessed portion having a rectangular, laterally elongated shape, said second recessed portion having a rectangular, laterally elongated shape;

said mop head comprising oppositely positioned flexible ear portions located at a front portion of said mop head, said first recessed portion extending laterally from one of said flexible ear portions to the other.

6. The mop head of claim 5, said first recessed portion comprising a substantially shorter lateral dimension than said second recessed portion.

7. The mop head of claim 6, said first recessed portion comprising a substantially smaller area than said second recessed portion.

* * * * *